US005720242A

United States Patent [19]

Izuo

[11] Patent Number: 5,720,242

[45] Date of Patent: Feb. 24, 1998

[54] INTERNAL COMBUSTION ENGINE EQUIPPED WITH AN ELECTROMAGNETIC VALVE DRIVING APPARATUS AND HEAD STRUCTURE THEREOF

[75] Inventor: Takashi Izuo, Toyota, Japan

[73] Assignee: Toyota Jidosha Kabushiki Kaisha, Aichi-Ken, Japan

[21] Appl. No.: 805,835

[22] Filed: Mar. 3, 1997

[30] Foreign Application Priority Data

Mar. 25, 1996 [JP] Japan ..... 8-068518

[51] Int. Cl.[6] ..... F01L 9/04; F02F 1/24

[52] U.S. Cl. ..... 123/90.11; 123/90.15; 123/193.3

[58] Field of Search ..... 123/90.11, 90.15, 123/193.5, 193.3

[56] References Cited

U.S. PATENT DOCUMENTS

| | | | |
|---|---|---|---|
| 4,878,464 | 11/1989 | Richeson, Jr. et al. | 123/90.11 |
| 5,005,539 | 4/1991 | Kawamura | 123/90.11 |
| 5,067,452 | 11/1991 | Elsbett et al. | 123/193 H |
| 5,271,229 | 12/1993 | Clarke et al. | 123/90.11 |
| 5,497,755 | 3/1996 | Maloney | 123/572 |
| 5,517,951 | 5/1996 | Paul et al. | 123/90.11 |

FOREIGN PATENT DOCUMENTS

| | | |
|---|---|---|
| 470874 | 2/1992 | European Pat. Off. . |
| 3807855 | 9/1989 | Germany . |
| 60-155708 | 10/1985 | Japan . |

*Primary Examiner*—Weilun Lo
*Attorney, Agent, or Firm*—Kenyon & Kenyon

[57] ABSTRACT

A head structure of an internal combustion engine includes a cylinder head, an electromagnetic valve driving apparatus, and a cover member. The cylinder head and the cover member provide an intake chamber. The electromagnetic valve driving apparatus is installed in the cylinder head so that it is partially extends into the intake chamber. The intake chamber is open to both an air inlet and intake port of the engine.

11 Claims, 8 Drawing Sheets

INTERNAL COMBUSTION ENGINE EQUIPPED WITH AN ELECTROMAGNETIC VALVE DRIVING APPARATUS AND HEAD STRUCTURE THEREOF

BACKGROUND OF THE INVENTION (1) Field of the Invention

The present invention generally relates to an internal combustion engine equipped with an electromagnetic valve driving apparatus and a head structure thereof and, more particularly, to an internal combustion engine equipped with an electromagnetic valve driving apparatus which is suitable to be mounted on an automobile and a head structure thereof.

(2) Description of the Related Art

An engine equipped with an electromagnetic valve driving apparatus is known as disclosed in Japanese Utility Model Laid-open No. 60-155708. The engine has intake valves and exhaust valves driven by an electromagnetic force generated by an electromagnetic valve driving apparatus. The electromagnetic valve driving apparatus eliminates a cam mechanism for driving an intake valve and an exhaust valve, generally used in the conventional engine.

The electromagnetic valve driving apparatus is mounted in a cylinder head of the engine. The engine has a head cover provided above the cylinder head. The electromagnetic valve driving apparatus is contained mainly in a space between the cylinder head and the head cover. The structure prevents foreign matter such as dust and water from entering the interior of the electromagnetic valve apparatus, and provides high reliability with the intake valves and the exhaust valves.

The cam mechanism used in the prior art is contained in a space between a cylinder head and a head cover of an engine as the same as in the electromagnetic valve driving apparatus is. The cam mechanism comprises a camshaft which rotates when the engine is operating, bearings which hold the camshaft rotatably, cams which rotate with the camshaft and cam seats which are kept in contact with the cams.

The camshaft and the bearings contact and rub each other when the engine is operating. The cams and the cam seats rub each other during the engine operation as well. Engine oil is required to flow into those contacting and rubbing portions, which prevents them from wearing out. Therefore, in the conventional engine, the space between the cylinder head and the head cover must be used as a space in which engine oil is sprayed to the rubbing portion.

On the contrary, in the engine equipped with the electromagnetic valve driving apparatus, it is not necessary to use the space between the cylinder and the head cover as a space to spray engin oil. Accordingly, with regard to such kind of engines, the space between the cylinder head and the head cover can be used as a space which is not sealed from the outside space of the engine.

SUMMARY OF THE INVENTION

It is a general object of the present invention to provide a novel and useful head structure of an internal combustion engine equipped with electromagnetic valve driving apparatus in which the problems discussed above are eliminated.

A more specific object of the present invention is to provide a head structure of an internal combustion engine equipped with an electromagnetic valve driving apparatus which makes good use of the interior space of an engine.

The above-mentioned object of the present invention is achieved by a head structure of an internal combustion engine which has a cylinder head having an intake port opening to a combustion chamber and an electromagnetic valve driving apparatus. The electromagnetic valve driving apparatus is installed in the cylinder head and drives a valve of the internal combustion engine. The head structure also has a cover member which covers the electromagnetic valve driving apparatus. The cover member and the cylinder head provides an intake chamber opening to both of an air inlet and the intake port of the internal combustion engine.

A further object of the present invention is to provide an internal combustion engine equipped with electromagnetic valve driving apparatus which makes good use of the interior space of an engine by using a space between a cylinder and a head cover as part of an intake passage.

The above-mentioned object of the present invention is achieved by an internal combustion engine equipped with an electromagnetic valve driving apparatus which has a cylinder head having an intake port opening to a combustion chamber and an electromagnetic valve driving apparatus. The electromagnetic valve driving apparatus is installed in the cylinder head and drives a valve of the internal combustion engine. The engine also has a cover member covering the electromagnetic valve driving apparatus. The cover member and the cylinder head provides an intake chamber which opens to both of an air inlet and the intake port of the internal combustion engine.

According to the present invention, the valve is driven by the electromagnetic valve driving apparatus. The electromagnetic valve driving apparatus requires no lubricating oil to operate smoothly. Therefore, in a case where the electromagnetic valve driving apparatus is used as a power supplier of the valve, it is not necessary to supply lubricating oil to a space provided between the cylinder head and the cover member.

In an internal combustion engine, an intake chamber having an appropriate volume is required for eliminating pulsation in intake air. In the present invention, the space provided between the cylinder head and the cover member is used as the intake chamber. Therefore, the head structure and the internal combustion engine make good use of the interior space of the engine, enabling the engine to be compact.

Other objects, features and advantages of the present invention will become more apparent from the following detailed description when read in conjunction with the accompanying drawings.

DESCRIPTION OF THE PREFERRED EMBODIMENTS

A description will now be given, with reference to FIG. 1 and FIG. 2, of an internal combustion engine equipped with electromagnetic valve driving apparatus according to an embodiment of the present invention.

Figure 1:
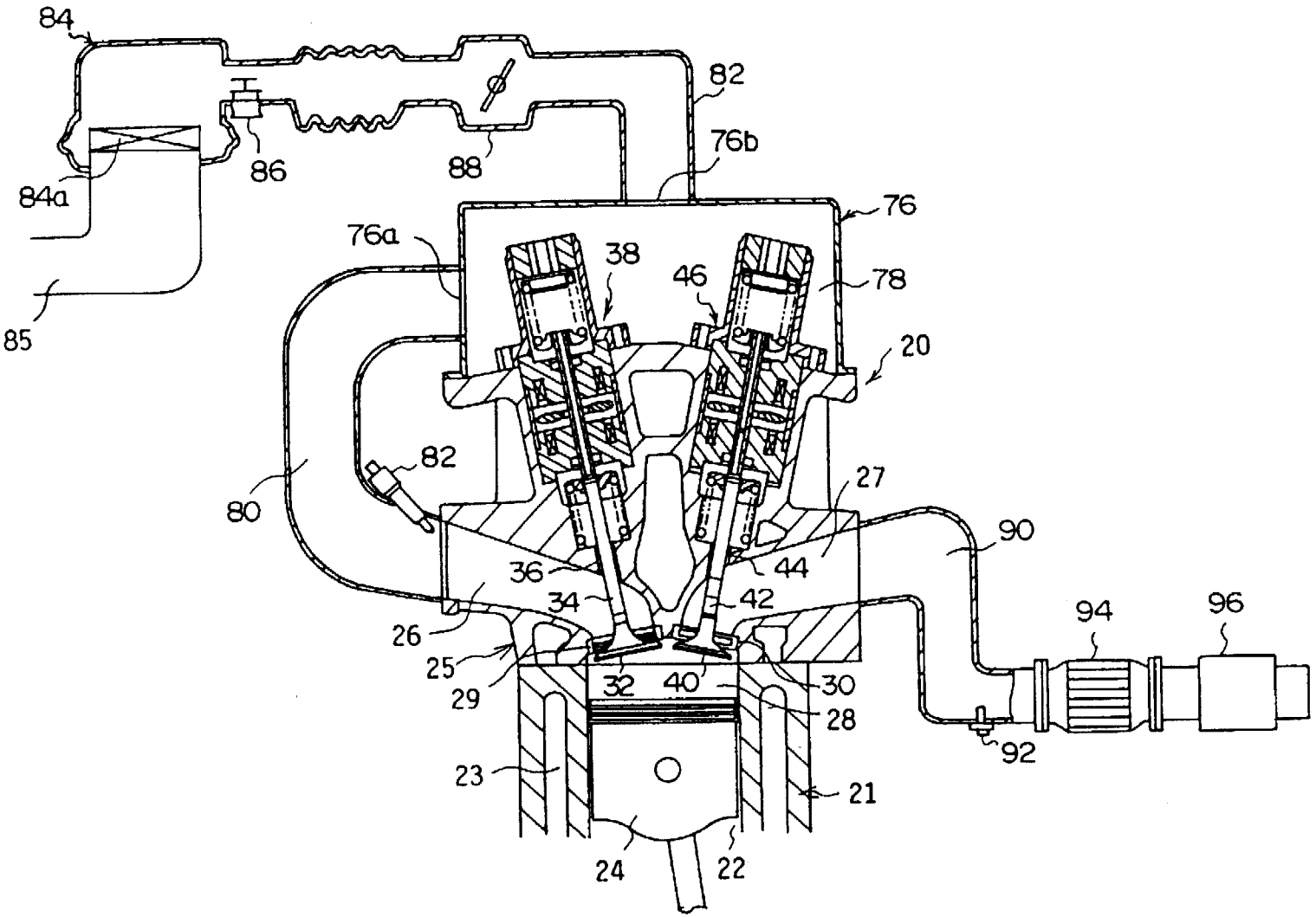
FIG. 1 is a drawing showing a structure of an internal combustion engine according to a first embodiment of the present invention.

FIG. 1 shows a structure of the engine 20 according to the first embodiment. The engine has a cylinder block 21. A plurality of cylinders including a cylinder 22 and a water jacket 23 are provided inside the cylinder block 21. A piston 24 is inserted in the cylinder 22 so that the piston 24 can reciprocate inside the cylinder 22 in an axial direction thereof.

A cylinder head 25 is mounted on the cylinder block 21. A plurality of intake ports and a plurality of exhaust ports are provided in the cylinder head 25. In the engine 20, two intake ports and two exhaust ports are provided to every cylinder provided in the cylinder block 21. FIG. 1 shows an intake port 26 and an exhaust port 27 among the plurality of intake and exhaust ports.

A combustion chamber 28 is provided between an interior wall of the cylinder 22, an upper surface of the piston 24 and a bottom surface of the cylinder head 25. Both of the intake port 26 and the exhaust port 27 open to the combustion chamber 28. The intake port 26 has a valve seat 29 at an opening portion to the combustion chamber 28. The exhaust port 27 has a valve seat 30 at an opening portion to the combustion chamber 28 as well.

An intake valve 32 secured to a valve shaft 34 is assembled to the cylinder head 25. The valve shaft is held by a valve guide 36 mounted in the cylinder head 25 so that the valve shaft 34 is movable in an axial direction thereof. The valve shaft 34 is connected to an electromagnetic valve driving apparatus 38 which reciprocates the valve shaft 34 and the intake valve 32 within a certain length. The intake port 26 is opened to the combustion chamber 28 when the intake valve 32 is raised from the valve seat 29 and is closed from the combustion chamber 28 when the intake valve 82 is seated on the valve seat 29.

An exhaust valve 40 is also assembled to the cylinder head 25. A valve shaft 42 held by a valve guide 44 mounted in the cylinder head 25 and connected to an electromagnetic valve driving apparatus 46 is secured to the exhaust valve 40. The exhaust valve 40 is reciprocated by the electromagnetic valve driving apparatus 46. The exhaust port 27 is opened to the combustion chamber 28 when the exhaust valve 40 is raised from the valve seat 80 and is closed from the combustion chamber 28 when the exhaust valve 40 is seated on the valve seat 80.

The electromagnetic valve driving apparatuses 38 and 46 have the same structure. Thus, a description of the structure of the electromagnetic valve driving apparatus 38, as a representative valve driving apparatus, will be given below with reference to FIG. 2. Incidentally, those parts shown in FIG. 1 are given the same reference number in FIG. 2 and the explanation thereof will be omitted.

Figure 2:
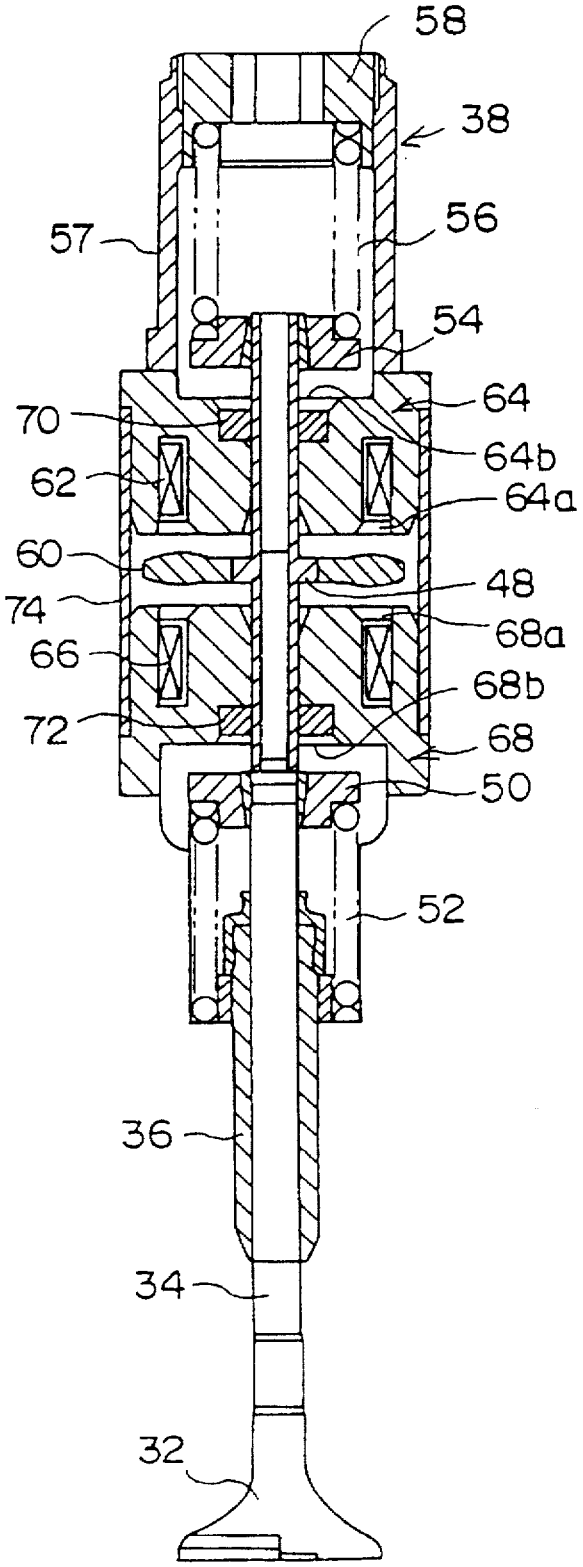
FIG. 2 is a cross sectional view of a electromagnetic valve driving apparatus and an intake valve used in the engine shown in FIG. 1.

As shown in FIG. 2, the electromagnetic valve driving apparatus 38 has an armature holder 48 which is secured to an upper edge of the valve shaft 34. The armature holder is made of a predetermined material which has a low magnetic property and a high hardness property, such as stainless steel and Ti alloy.

A lower retainer 50 is secured to a lower edge of the armature holder 48. A lower spring 52 is provided under the lower retainer 50. A lower edge of the lower spring 52 contacts the cylinder head 25. The lower spring 52 generates a spring force which pushes the lower retainer 50 and the armature holder 48 toward an upper side in FIG. 2.

An upper retainer 54 is secured to an upper edge of the armature holder 48. An upper spring 56 is provided on the upper retainer 54 so that a lower edge of the upper spring 56 contacts the upper retainer 54. An upper cap 57 is provided around the upper spring 56. An adjust bolt 58 is provided at an upper edge of the upper cap 57. An upper edge of the upper spring 56 contacts the adjust bolt 58. The upper spring 56 generates a spring force which pushes the upper retainer 54 and the armature holder 48 toward the lower side in the FIG. 2.

An armature 60 is secured to the outer circumference of the armature holder 48. The armature 60 is a member which has a ring shape and is made of a predetermined material which has a high magnetic property, such as alloys containing Fe, Ni and Co. A first solenoid coil 62 and a first magnetic core 64 are provided above the armature 60. A second solenoid coil 66 and a second magnetic core 68 are provided below the armature 60 as well. The first magnetic core 64 and the second magnetic core 68 have a high magnetic property. The first solenoid coil 62 and the second solenoid coil 66 are installed in ring shaped gutters **64*a* or 68*a*, respectively, which are provided in the first magnetic core 64 and the second magnetic core 68**.

The first magnetic core 64 has a through hole **64*b*. The second magnetic core 68 has a through hole 68*b* as well. A first bearing 70 and a second bearing 72 are mounted at an upper edge of the through hole 64*b* and a lower edge of the through hole 68*b*, respectively. The first bearing 70 and the second bearing 72 are dry type bearings which do not require a supply of lubricating oil. The first bearing 70 and the second bearing 72 are made of a lubricate material, such as, SiC, $Si_3N_4$ and fluorine resin. The first bearing 70 and the second bearing 72 hold the armature holder 48, which is inserted into the through holes 64*b* and 68*b*** so that the armature holder can move in an axial direction thereof.

A sleeve 74 is mounted at an outer circumference of the first magnetic core 64 and the second magnetic core 68. The sleeve 74 fixes a relative position of the first magnetic core 64 and the second magnetic core 68 so that a certain distance is provided between the first magnetic core 64 and the second magnetic core 68. A neutral position of the armature 60 which is fixed by a balance of the spring force of the lower spring 52 and the spring force of the upper spring 56 is adjusted at the middle position of the first magnetic core 64 and the second magnetic core 68 by adjusting the adjust bolt 58.

The armature 60 remains in the neutral position when no electric current flows through either the first solenoid coil 62 or the second solenoid coil 66. When electric current start to flow through the first solenoid coil, a magnetic field is generated. The magnetic field causes magnetic flux to flow through the first magnetic core 64, the armature 60 and air gaps between the first magnetic core 64 and the armature 60. The magnetic flux flowing through the armature generates an electromagnetic force which attracts the armature 60 toward the first magnetic core.

As a result, when electric current flows through the first solenoid coil 62, the intake valve 32 with the armature 60, moves toward the upper side in FIG. 2 against the spring force of the upper spring 56 until the armature 60 contacts the first magnetic core 64. The intake valve 32 seats itself on the valve seat 29 shown in FIG. 1 in the case where the armature 60 contacts the first magnetic core 64. Hereinafter, a state in which the intake valve 32 seats itself on the valve seat 29 will be referred to as "a closed state" and positions of the intake valve 32 and the armature 60 in the closed state will be referred to as "a closed position".

When the electric current flowing through the first magnetic core is cut or terminated in a closed state, the electromagnetic force exerted on the armature goes off. After that, the armature 60 and the intake valve 32 start to move toward the lower side in FIG. 2 by being pushed by the upper spring 56. Electric current is supplied to the second solenoid coil 66 at a certain time when a displacement value of the armature 60 reaches a certain value. At this time, an electromagnetic force which attracts the armature 60 toward the second magnetic core 68 is generated.

The electromagnetic force discussed above causes the armature 60 and the intake valve 32 to move toward the lower side of FIG. 2 until the armature contacts the second magnetic core 68. Hereinafter, a state in which the armature contacts the second magnetic core 68 will be referred to as "a open state" and positions of the intake valve 32 and the armature 60 under the open state will be referred to as "a open position".

As discussed above, according to the electromagnetic valve driving apparatus 38, the intake valve 32 can be held at the closed position by applying the electric current to the first solenoid coil 62 and can be held at the open position by applying the electric current to the second solenoid coil 66. Therefore, the intake valve 32 reciprocates between the closed position and the open position when the electric current is alternatively supplied to the first solenoid coil 62 and the second solenoid coil 66.

The electromagnetic valve driving apparatus 46 shown in FIG. 1 has dry type bearings as does the electromagnetic valve driving apparatus 38. Therefore, unlike conventional engines equipped with a cam is mechanism, the engine 20 requires no lubricating oil to operate the intake valve 32 and the exhaust valve 40 smoothly.

As shown in FIG. 1, the engine 20 has a head cover 76 on the cylinder head 25. The head cover 76 divides an intake chamber 78 above the cylinder head 25. The electromagnetic valve driving apparatuses 38 and 46 installed in the cylinder head 25 are contained in the intake chamber 78. A plurality of opening portions including an opening portion **76*a* are provided at a side wall of the head cover 76. An intake manifold 80 is connected to the opening portions at an edge thereof. The intake manifold 80 has a plurality of branches each of which is independent for and connected to each intake port of the engine 20. Injectors for spraying fuel into the intake ports are mounted to each of the branches of the intake manifold 80. An injector 82 shown in FIG. 1 is provided for spraying fuel into the intake port 26**.

An opening portion **76*b* connected to an intake pipe 82 is provided to the head cover 76. The intake pipe 82 is connected to an air filter 84, which is opned to an air inlet 85, at the end thereof. Air is led into the intake pipe 82 after being filtered by the air filter 84. An air flow meter 86 is provided behind the air filter 84. The air flow meter 86 generates an electric signal corresponding to an amount of intake air. A throttle valve 88 is also provided in the intake pipe 82. The opening angle of the throttle valve 88 changes corresponding to the operation of an accelerator pedal. The amount of the intake air is controlled by the throttle valve 88**.

An exhaust pipe 90 is connected to the exhaust port 27 of the cylinder head 25. $O_2$ sensor 92 is provided to the exhaust pipe 90. The $O_2$ sensor 92 generates an electric signal corresponding to oxygen density in exhaust gas flowing through the exhaust pipe 90. The oxygen density decrease as an air fuel mixture delivered to the combustion chamber 28 becomes leaner and increase as the mixture becomes richer. The $O_2$ sensor 92 outputs a high level signal when an air fuel ratio of the mixture is richer than the stoichiometric air fuel ratio and outputs a low level signal when the air fuel ratio of the mixture is leaner than the stoichiometric air fuel mixture.

A catalytic converter 94 and muffler 96 are provided behind the $O_2$ sensor 92. The catalytic converter 94 cleans the exhaust gas flowing through the exhaust pipe 90 by oxidizing non fired matter such as CO and HO, and deoxidizing oxidized matter such as NOx. The exhaust gas is emitted to the atmosphere after being cleaned by the catalytic converter 94 and passed through the muffler 96.

Hereinafter, a description of features of the engine 20 will be given. As discussed above, the engine 20 has the intake chamber 78 divided by the head cover 76. Incidentally, an intake chamber is usually provided in an intake system of an internal combustion engine for eliminating pulsation of intake air. To eliminate the pulsation efficiently, it is necessary to provide an intake chamber, which has a large volume, between an air filter and intake ports.

In the conventional engine equipped with the cam mechanism, it is necessary to provide a space above a cylinder head for containing the cam mechanism. Since the cam mechanism requires lubricating oil to operate smoothly, the space above the cylinder head must be sealed by a head cover for preventing the lubricating oil from flowing out of the engine. Therefore, in the conventional engine, it is not possible to use the space provided between the cylinder head and the head cover as an intake chamber for eliminating pulsations of intake air.

In the engine 20 of the present embodiment, since no lubricating oil is required to operate the intake valve 32 and the exhaust valve 40 smoothly, no lubricating oil is supplied to the intake chamber 78. Therefore, although the intake chamber 78 is connected to the intake pipe 82 and the intake manifold 80, no harmful effect occurs in the engine 20. Further, the intake chamber 78 of the engine 20 has a large volume so as to contain all of the electromagnetic valve driving apparatus installed in the engine 20. Therefore, according to the intake chamber 78, the pulsation which would otherwise occur in the intake air will be efficiently eliminated.

As discussed above, the head structure of the engine 20 makes good use of a space around the engine 20. Accordingly, the engine 20 according to the present embodiment will be more compact than the conventional engine which has an intake chamber and the space above the cylinder head individually.

In the engine 20, the electromagnetic valve driving apparatuses 38 and 46 are partially exposed to the intake air flowing through the intake chamber 78. The intake air flowing around the electromagnetic valve driving apparatuses 38 and 46 acts as an coolant thereof when the engine 20 is operating. Therefore, according to the head structure of the present embodiment, the electromagnetic valve driving apparatuses 38 and 46 will be efficiently cooled during engine operation.

During engine operation, a high combustion pressure is generated in the combustion chamber 28. In some cases, the exhaust gas having high pressure flows from the combustion chamber 28, through gaps between the valve guide 36 and the valve shaft 34 and between the valve guide 44 and the valve shaft 42, into the intake chamber 78. In a case where the intake chamber 78 is sealed, the exhaust gas flowing into the intake chamber 78 is accumulated therein. However, according to the head structure of the engine 20, the exhaust gas flowing into the intake chamber 78 is led to the combustion chamber 28 through the intake manifold 80. Therefore, the intake chamber 78 of the engine 20 remains cleaner than the space provided above the cylinder head of the conventional engine.

Figure 3:
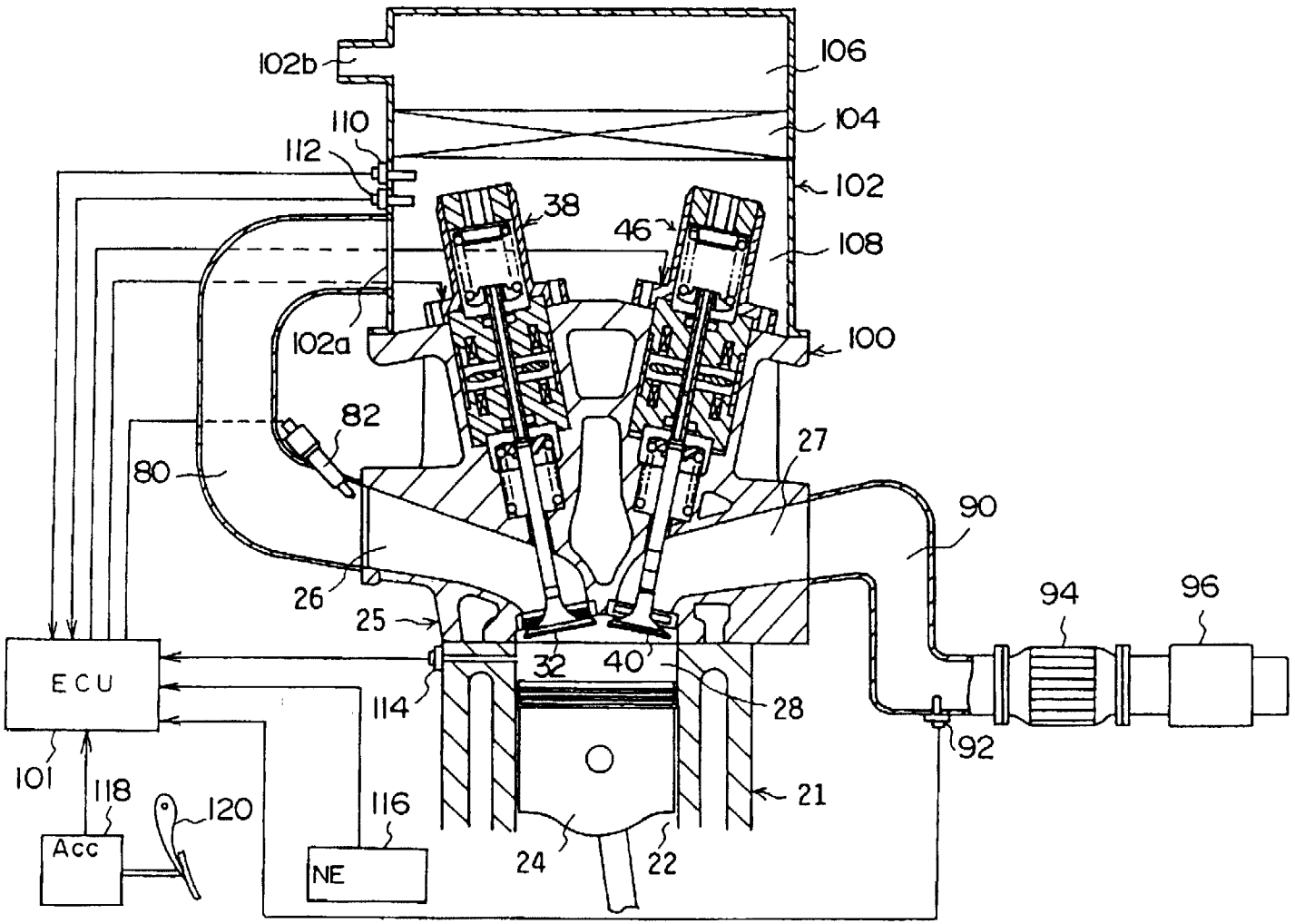
FIG. 3 is a drawing showing a structure of an internal combustion engine according to a second embodiment of the present invention.

Hereinafter, an description of the second embodiment of the present invention will be given with reference of FIG. 3. FIG. 3 shows a structure of an engine 100 of the present embodiment. Incidentally, those parts which are also shown in FIG. 2 are given the same reference number in FIG. 3 and the explanation thereof will be omitted.

The engine 100 has an electronic control unit 101 (hereinafter, it is referred to as an "ECU 101"). The engine 100 is controlled by the ECU. The engine 100 also has a head cover 102. The head cover 102 has a plurality of opening portions including a opening portion 102*a* at a side wall thereof and an air inlet 102*b* at an upper side thereof. The opening portions of the head cover 102 are connected to the intake manifold 80.

A filter element 104 is mounted inside the head cover 102. The filter element 104 divides an inner space of the head cover 102 into a first chamber 106 opening to the air inlet 102*b* and a second chamber 108 opening to the intake manifold 80. An atmospheric pressure sensor 110 and an intake air temperature sensor 112 are provided to the head cover 102. The atmospheric pressure sensor 110 generates an output signal corresponding to the pressure of the second chamber 108. The intake air temperature sensor 112 generates an output signal corresponding to a temperature inside the second chamber 108. The ECU 101 continuously receives the output signals from the sensors 110 and 112. ECU 101 calculates an atmospheric pressure and a temperature of the intake air based on the output signals.

The engine 20 has an combustion pressure sensor 114 and an NE sensor 116. The combustion pressure sensor 114 is installed in the cylinder block 21, generating an electric signal corresponding to a pressure inside the combustion chamber 28. The NE sensor 116 generates pulse signals at intervals corresponding to a revolution speed of the engine 100. The electric signal generated by the combustion pressure sensor 114 and the pulse signals generated by the NE sensor 116 are supplied to the ECU 101 as well as the electric signal generated by the $O_2$ sensor 92. The ECU 101 calculates a combustion pressure, an engine rpm and an air fuel ratio based on the signals and detects engine operating condition based on the result of the calculation.

The engine has an accelerator opening angle sensor 118. The accelerator opening angle sensor 118 is linked to an accelerator pedal 120, generating an electric signal corresponding to an accelerator opening angle AACC and supplying the electric signal to the ECU 101. The ECU 101 detects an operation of the accelerator pedal 120 by a driver based on the electric signal.

The ECU 101 controls an opening timing and a closing timing of the intake valve 32 to control an amount of intake air inducted into the combustion chamber 28 with respect to the operation of the accelerator pedal 120. The ECU 101 also controls a fuel injection duration by controlling a duration of operating signal supplied to the injector 82 for obtaining an appropriate air fuel ratio. Further description of the operational procedure performed by the ECU 101 will be given later.

In the engine 100, the second chamber divided by the cylinder head 25, the head cover 102 and the filter element 104 acts as an intake chamber which eliminates pulsations of intake air. Further, the second chamber 108 has a large volume so as to contain all of the electromagnetic valve driving apparatus installed in the engine 100. Therefore, according to the intake chamber 78, the pulsations occurring in the intake air will be efficiently eliminated.

As discussed above, the engine 100 has neither an air flow meter nor a throttle valve. That is, amount of the intake air can be controlled to an appropriate value without both an air flow meter and a throttle valve in the engine 100. As a result, according to the engine 100, all elements which constitute an intake system of the engine 100 can be installed inside the head cover 102. Therefore, the engine 100 is more compact than the engine 20 shown in FIG. 1. Incidentally, the electromagnetic valve driving apparatuses installed in the engine 100 are effectively cooled by the intake air as well as the electromagnetic valve driving apparatus installed in the engine 20. Further, the second chamber 108 is kept clean by the flow of intake air as well as the intake chamber 78 of the engine 20.

Hereinafter, an description of a procedure performed by the ECU 101 will be given with reference to FIG. 4 through FIG. 9.

Figure 4:
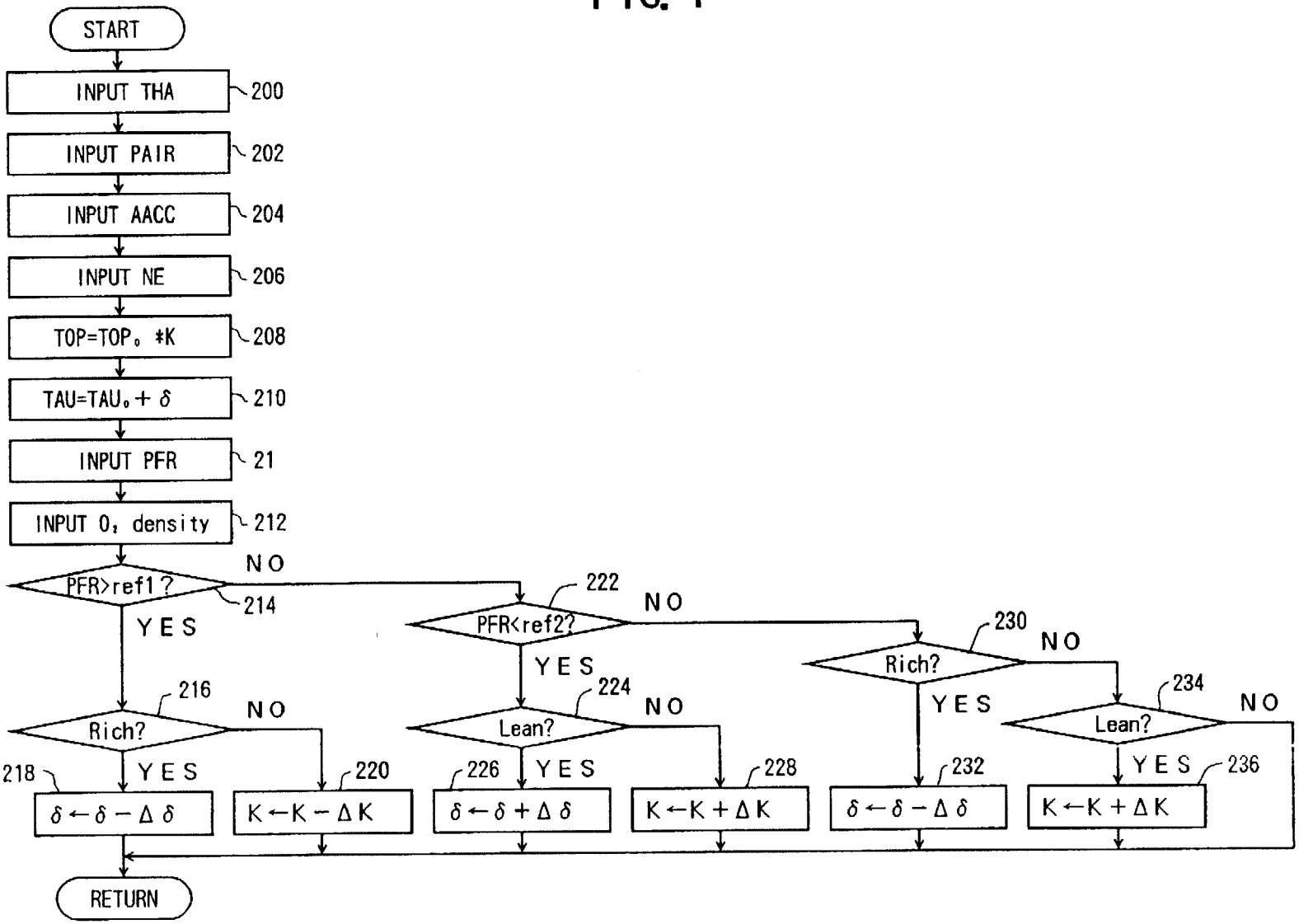
FIG. 4 is a flowchart of a procedure conducted by the ECU shown in FIG. 3.

FIG. 4 shows a flowchart of a routine which is performed by the ECU 101 for controlling an amount of the intake air with respect to the operation of the accelerator pedal 120 and controlling a fuel injection duration so as to obtain an appropriate air fuel ratio. The routine shown in FIG. 4 is started whenever a crank angle of the engine 100 corresponds to a reference crank angle. When the routine is started, a procedure of step 200 is first performed.

Figure 5:
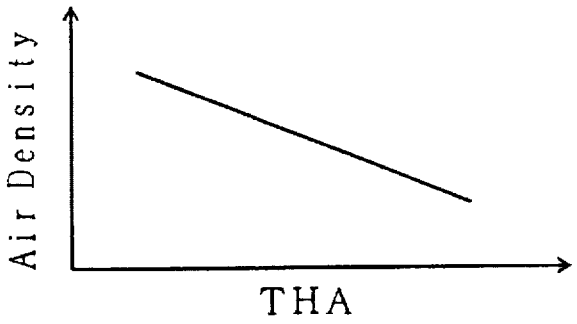
FIG. 5 is a drawing showing a correlation between intake air temperature THA and intake air density.

In step 200, an electric signal corresponding to an intake air temperature THA is received from the intake air temperature sensor 112. FIG. 5 shows a correlation between air density and the THA. As shown in FIG. 5, air density of the intake air inducted into the combustion chamber 28 changes in proportion to the THA. In the present embodiment, since the engine 100 controls the amount of intake air by controlling the opening timing and the closing timing of the intake valve as discussed above, mass of the intake air changes with respect to the change of the air density. The ECU 101 prevents the mass of the intake air from shifting from a certain value by taking the THA into is account.

Figure 6:
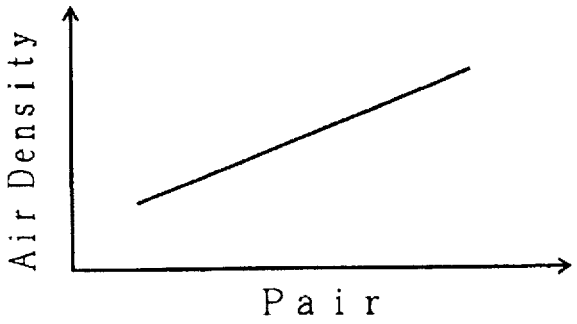
FIG. 6 is a drawing showing a correlation between intake air pressure PAIR and intake air density.

In step 202, an electric signal corresponding to an atmospheric pressure PAIR is received from the atmospheric pressure sensor 110. FIG. 6 shows a correlation between air density and the PAIR. As shown in FIG. 6, air density of the intake air inducted into the combustion chamber 28 changes in proportion to the PAIR. The ECU 101 prevents the mass of the intake air from shifting from a certain value by taking the PAIR into account.

In step 204, an electric signal corresponding to an accelerator opening angle AACC is received from the accelerator opening angle sensor 118. The AACC increases as a driver requires increased engine output. The ECU 101 calculates opening duration of the intake valve 32 in a manner discussed later.

In step 206, the engine rpm NE is calculated based on the pulse signals output from the NE sensor 116.

In step 208, the opening timing and the closing timing of the intake valve 32 is calculated. More particularly, the opening timing is calculated so that the opening timing corresponds to a timing when a crank angle of the engine 20 corresponds to one of the certain crank angles which is predetermined for each cylinder. Further, the closing timing is calculated so that the intake valve 32 remains at the open position during an appropriate opening duration TOP after the opening timing.

The opening duration TOP of the intake valve 32 is calculated by multiplying a base opening duration $TOP_0$ and a correction factor K. The correction factor K is calculated based on the intake air temperature THA is and the atmospheric pressure PAIR. The base opening duration $TOP_0$ is calculated based on the accelerator opening angle AACC with reference to a map shown in FIG. 7.

Figure 7:
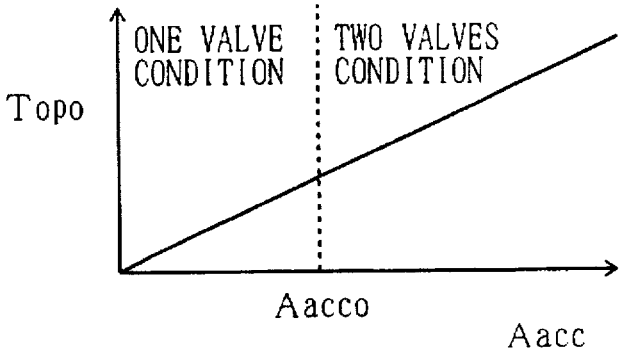
FIG. 7 is a map registered in the ECU shown in FIG. 3 which shows a correlation between accelerator opening angle AACC and basic opening duration of an intake valve $TOP_0$.

The map shown in FIG. 7 provides a correlation between the $TOP_0$ and the AACC. ECU 100 calculates the base opening duration $TOP_0$ with respect to the correlation shown in FIG. 7. Incidentally, the engine 100 has two intake valves at each cylinder as well as the engine 20 shown in FIG. 1. In the present embodiment, only one intake valve of each cylinder is driven in a condition (the condition is referred to as "one valve condition") where the AACC is less than a predetermined value $AACC_0$ and two intake valves of each cylinder are driven in a case (the condition is referred to as "two valves condition") where the AACC is more than the $AACC_0$. This driving manner improves precision of the intake air control under a wide range of engine operating conditions.

Figure 8:
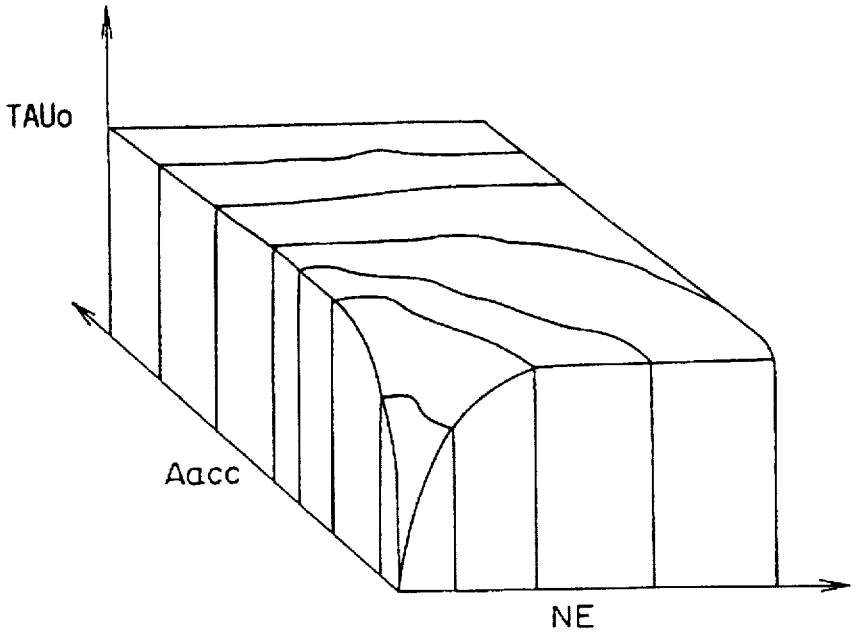
FIG. 8 is a map registered in the ECU shown in FIG. 3 which shows correlations among engine rpm NE, accelerator opening angle AACC and basic fuel injection duration $TAU_0$.

In step 210, fuel injection duration TAU is calculated. The TAU is calculated by adding a correction factor δ to a base fuel injection duration $TAU_0$. The ECU 101 calculates the base fuel injection duration based on the accelerator opening angle AACC and the engine rpm NE with reference to a map shown in FIG. 8. The map shown in FIG. 8 provides a correlation among the AACC, the NE and the $TAU_0$. More particularly, the map shown in FIG. 8 is provided so that the air fuel ratio of the mixture inducted into the combustion chamber 28 is in accordance with the stoichiometric air fuel ratio when fuel is injected with respect to the base fuel injection duration $TAU_0$. After calculating the $TAU_0$, the ECU calculates a fuel injection duration which is used in this procedure cycle by adding a correction factor δ calculated in a previous procedure cycle to the $TAU_0$.

In step 202, an electric signal corresponding to an combustion pressure PFR is received from the combustion pressure sensor 114.

In step 204, an electric signal corresponding to an oxygen density in the mixture supplied to the combustion chamber 28 is received from the $O_2$ sensor 92.

The combustion pressure PFR will be an appropriate value corresponding to the accelerator opening angle AACC when both the amount of intake air and the fuel injection duration TAU are controlled correctly. In other words, it is possible to determine whether the amount of the intake air and the fuel injection duration TAU are appropriate by comparing the combustion pressure and TAU with reference values, respectively.

In step 214, it is determined whether the combustion pressure PFR is more than a first reference value which is a variable corresponding to the accelerator opening angle AACC. In a case where the combustion pressure PFR exceeds the first reference value, it can be assumed that excessive intake air or excessive fuel is supplied to the engine 100. In this case, the routine proceeds to step 216.

Figure 9:
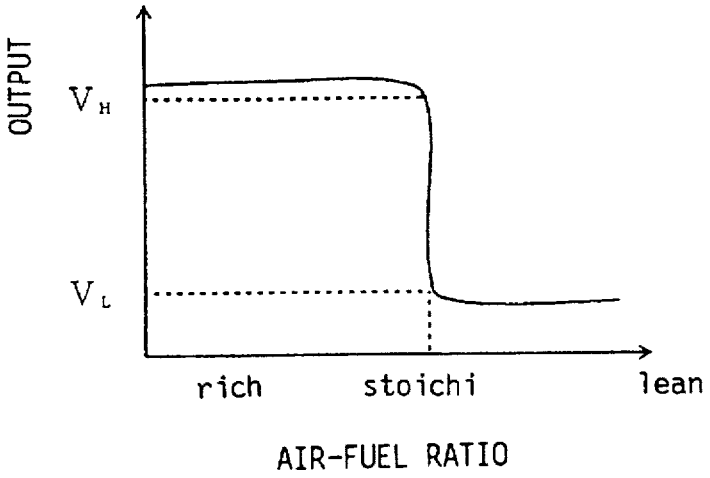
FIG. 9 is a drawing showing a correlation between the air-fuel ratio and output voltage of the oxygen sensor shown in FIG. 3.

In step 216, it is determined whether the air fuel mixture is richer than the stoichiometric air fuel mixture based on the output signal supplied from the $O_2$ sensor 92. As discussed above, the $O_2$ sensor 92 outputs a high signal or a low signal with respect to the oxygen density of the mixture. FIG. 9 shows a correlation between the air fuel ratio and the output signal of the $O_2$ sensor 92. As shown in FIG. 9, the output signal of the $O_2$ sensor 92 exceeds a certain value VH when the mixture is rich and falls under a certain value VL when the mixture is lean. The ECU 101 determines that the mixture is rich when the output signal is higher than VH. In this case, the routine proceeds to step 218 from the present step 216. The ECU 101 determines that the mixture is lean when the output signal is less than VL. In this case, the routine proceeds to step 220.

In step 218, a predetermined value Δδ is subtracted from the correction factor δ. The new correction factor δ will be used to correct TAU in the next cycle of the procedure. According to the above procedure, the amount of fuel will be reduced in the next cycle of the procedure. As a result, the combustion pressure PFR will decrease toward an appropriate level and the air fuel ratio will be corrected toward the lean side, namely toward the stoichiometric air fuel ratio. When the procedure of the step 218 is finished, the routine of this cycle of the procedure is finished.

In step 220, a predetermined value ΔK is subtracted from the correction factor K. The new correction factor K will be used to correct the opening duration TOP of the intake valve 32 in the next cycle of the procedure. According to the above procedure, the amount of the intake air will be reduced in the next cycle of the procedure. As a result, the combustion pressure PFR will decrease toward an appropriate level and the air fuel ratio will be corrected toward the rich side, namely toward the stoichiometric air fuel ratio. When the procedure of the step 220 is finished, the routine of this cycle of the procedure is finished.

In this routine, in a case where it is determined that the combustion pressure PFR does not exceed the first reference value in the above step 214, the routine proceeds to step 222 after step 214.

In step 222, it is determined whether the combustion pressure PFR is less than a second reference value which is a variable corresponding to the accelerator opening angle AACC. In a case where a combustion pressure PFR is less than the second reference value, it can be assumed that at least one of the intake air and the fuel injection duration TAU is insufficient. In this case, the routine proceeds to step 224 from step 222.

In step 224, it is determined whether the air fuel mixture is leaner than the stoichiometric air fuel mixture. As a result, in a case where it is determined that the air fuel mixture is lean, the routine proceeds to step 226. On the other hand, in a case where it is determined that the air fuel mixture is not lean, the routine proceeds to step 228 from step 224.

In step 226, a predetermined value Δδ is added to the correction factor δ. The new correction factor δ will be used to correct TAU in the next cycle of the procedure. According to the above procedure, the amount of the fuel will be increased in the next cycle of the procedure. As a result, the combustion pressure PFR will increase toward an appropriate level and the air fuel ratio will be corrected toward the rich side, namely toward the stoichiometric air fuel ratio. When the procedure of the step 226 is finished, the routine of this cycle of the procedure is finished.

In step 228, a predetermined value ΔK is added to the correction factor K. The new correction factor K will be used to correct the opening duration TOP of the intake valve 32 in the next cycle of the procedure. According to the above procedure, the amount of the intake air will increase in the next cycle of the procedure. As a result, the combustion pressure PFR will increase toward an appropriate level and the air fuel ratio will be corrected toward the lean side, namely toward the stoichiometric air fuel ratio. When the procedure of the step 228 is finished, the routine of this cycle of the procedure is finished.

In the present embodiment, the ECU determined that the combustion pressure PFR is an appropriate level in a case where it is determined that the combustion pressure PFR is not less than the second reference value in the above step 222. In this case, the routine proceeds to step 230.

In step 230, it is determined whether the air fuel mixture is richer than the stoichiometric air fuel mixture. As a result, in a case where it is determined that the air fuel mixture is lean, the routine proceeds to step 232. On the other hand, in a case where it is determined that the air fuel mixture is not rich, the routine proceeds to step 234 after step 230.

In step 232, a predetermined value $\Delta\delta$ is subtracted from the correction factor $\delta$. According to the above procedure, the air fuel ratio will be corrected toward the stoichiometric air fuel ratio. When the procedure of the step 232 is finished, the routine of this cycle of the procedure is finished.

In step 234, it is determined whether the air fuel mixture is leaner than the stoichiometric air fuel mixture. As a result, in a case where it is determined that the air fuel mixture is lean, the routine proceeds to step 236.

In step 236, a predetermined value $\Delta K$ is added to the correction factor K. The new correction factor K will be used to correct the opening duration TOP of the intake valve 32 in the next cycle of the procedure. According to the above procedure, the amount of the intake air will increase, correcting the air fuel ratio toward the stoichiometric air fuel ratio. When the procedure of the step 236 is finished, the routine of this cycle of the procedure is finished.

The ECU 101 determines that both the fuel injection duration TAU and the opening duration of the intake valve 32 are appropriate in a case where the air fuel mixture is not lean in the above step 234. In this case, the routine of this cycle will be finished without any further procedure.

According to the routine discussed above, the amount of the intake air and the fuel injection duration TAU are controlled with high precision by a feedback control based on the .combustion pressure PFR and the air fuel mixture. As a result, in the embodiment according to the engine 100, it is possible to keep the air fuel ratio of the mixture close to the stoichiometric air fuel ratio, so as to provide a clean exhaust emission, and to generate an appropriate combustion pressure with respect to an accelerator operation by a driver, so as to provide good driveability. As discussed above, the head structure of the present embodiment enables the engine 100 to be more compact than the conventional engine without any harmful effects.

Figure 10:
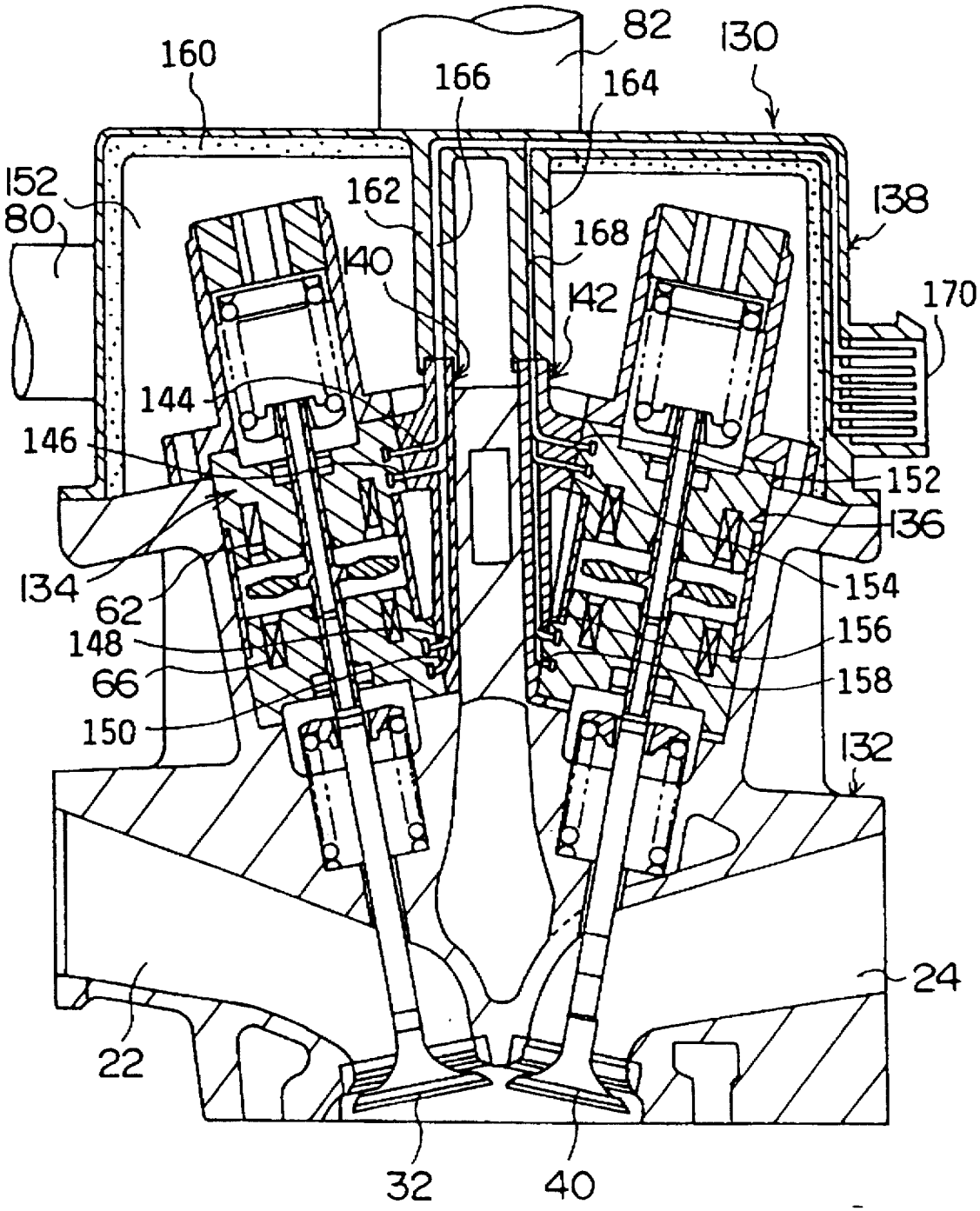
FIG. 10 is a drawing showing a structure of an internal combustion engine according to a third embodiment of the present invention.

Hereinafter, a description of a third embodiment of the present invention will be given with reference to FIG. 10 and FIG. 11. FIG. 10 shows a structure of the engine 130 according to the present embodiment. Incidentally, those parts also shown in FIG. 1 or FIG. 3 will be given the same reference number in FIG. 10 and the explanation thereof will be omitted.

The engine 130 has a cylinder head 132, electromagnetic valve driving apparatuses 134 and 136 and a head cover 138. The electromagnetic valve driving apparatuses 134 and 136 have connectors 140 and 142, respectively. Terminals 144, 146, 148 and 150 are molded in the connector 140. Terminals 144 and 146 are connected to the first solenoid coil 62 of the electromagnetic valve driving apparatus 134. Terminals 148 and 150 are molded in the connector 140. Terminals 148 and 150 are connected to the second solenoid coil 66 of the electromagnetic valve driving apparatus 134.

Terminals 154 and 156 which are connected to the first solenoid coil 62 of the electromagnetic valve driving apparatus 136 and terminals 158 and 160 which are connected to the second electromagnetic valve driving apparatus 136 are molded in the connector 142 as well. The cylinder head 132 is designed so as to be able to contain the connectors 140 and 142. On the other side, the connectors 140 and 142 are designed so as to project an edge thereof out above the cylinder head 132 when they are assembled to the cylinder head 132.

A sound absorbing material 160 and connecting portions 162 and 164 are provided inside the head cover 138. The connecting portions 162 and 164 are connected to the connectors 140 and 142, respectively, when the head cover 138 is assembled to the cylinder head 132. A plurality of terminals including a terminal 166 which is connected to the terminals 144, 146, 148 and 150 independently, is molded in the connecting portion 162. A plurality of terminals including a terminal 168 which is connected to the terminals 152, 154, 156 and 158 independently, is molded in the connecting portion 164.

The head cover 138 has the same number of connecting portions as the number of the electromagnetic valve driving apparatus provided to the engine 130. Every connecting portion has a plurality of terminals as well as the connecting portions 162 and 164. The head cover 138 has a integrated connector 170 outside thereof. Every terminal molded in the connecting portions provided inside the head cover 138 is led to the integrated connector 170 passing through the inside of the wall of the head cover 138. Therefore, according to the engine 130, it is possible to connect all of the electromagnetic valve driving apparatuses provided to the engine 130 and a driving apparatus of the electromagnetic valve driving apparatus which is electrically mounted outside the engine 130 by merely connecting a wiring harness to the integrated connector 170. Accordingly, the head structure of the present embodiment improves the workability of the engine assembly procedure.

In the present embodiment, the engine 130 has four electromagnetic valve driving apparatuses for each cylinder. Since distances between each electromagnetic valve apparatus and the integrated connector 148 are not the same, lengths of the terminals laying between each electromagnetic valve driving apparatus and the integrated connector 148 is not the same. An electric resistance value of the terminal increases in proportion to a length thereof. Therefore, in a case where all terminals provided in the head cover have the same specification except for the length, electric signals having different voltage values, respectively, will be supplied to each electromagnetic valve driving apparatus.

Figure 11:
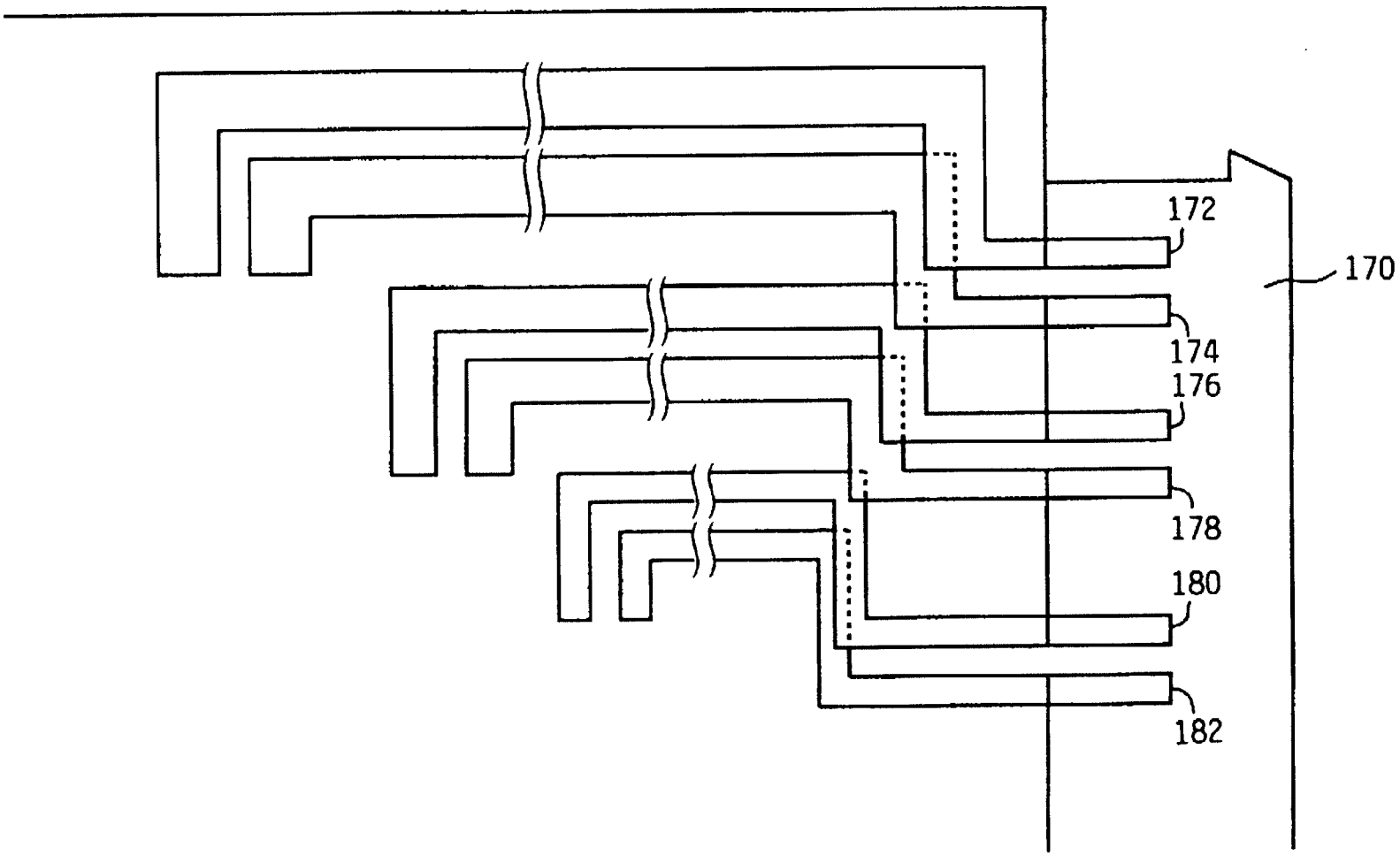
FIG. 11 is a drawing showing a structure of the integrated connecter shown in FIG. 10.

FIG. 11 is an enlarged view of a structure of the integrated connector 170. Terminals 172 and 174 shown in FIG. 11 are the terminals which are connected to an electromagnetic valve driving apparatus mounted at the farthest place from the integrated connector 170. On the contrary, Terminals 180 and 182 shown in FIG. 11 are the terminals which are connected to an electromagnetic valve driving apparatus mounted at the closest place from the integrated connector 170.

Electric resistance values of terminals 172~182 are in proportion to lengths thereof. The electric resistance values of the terminals 172~182 are in inverse proportion to sectional areas thereof. In the present embodiment, a width of the terminals 172~182 is designed so that all of the electric resistance values of the terminals 172~182 are of the same value. More particularly, the width of the terminals 176 and 178 is designed to be less than the width of the terminals 172 and 174 so that the electric resistance value of the terminals 176 and 178 corresponds to the electric resistance value of the terminals 172 and 174. Further, the width of the terminals 180 and 182 is designed to be less than the width of the terminals 176 and 178 so that the electric resistance value of the terminals 180 and 182 corresponds to the electric resistance value of the terminals 176 and 178.

Therefore, according to the head structure of the present embodiment, it is possible to supply the same voltage to all of the electromagnetic valve driving apparatuses of the engine 180. Incidentally, the space provided between the head cover 188 and the cylinder head 132 can be used as an intake chamber of the engine 130 in the same manner as the intake chamber 78 shown in FIG. 1 and the second chamber 108 shown in FIG. 3. Accordingly, the head structure of the present embodiment enables the engine 130 to be more compact than the conventional engine as well as the first and second embodiment.

The present invention is not limited to the specifically disclosed embodiments, and variations and modifications may be made without departing from the scope of the present invention.

What is claimed is:

1. A head structure of an internal combustion engine comprising:

a cylinder head having an intake port openable to a combustion chamber;

an electromagnetic valve driving apparatus, said electromagnetic valve driving apparatus being installed in said cylinder head and driving a valve of the internal combustion engine;

a cover member covering said electromagnetic valve driving apparatus;

said cover member and said cylinder head providing an intake chamber; and said intake chamber being open to both an air inlet of the internal combustion engine and said intake port.

2. The head structure of an internal combustion engine as claimed in claim 1, further comprising:

an air filter provided between the air inlet and said intake chamber.

3. The head structure of an internal combustion engine as claimed in claim 1, further comprising:

an intake manifold having branches which are independent to each cylinder of the internal combustion engine; and said intake chamber and said intake port connected via said intake manifold.

4. The head structure of an internal combustion engine as claimed in claim 1, wherein said electromagnetic valve driving apparatus is at least partially exposed to said intake chamber.

5. The head structure of an internal combustion engine as claimed in claim 1, wherein said electromagnetic valve driving apparatus being positioned at least partially in said intake chamber.

6. The head structure of an internal combustion engine as claimed in claim 2, wherein;

said cover member provided with said air inlet and an open portion which opens to said intake port; and said air filter being provided between said air inlet and said open portion so as to provide said intake chamber which opens to said intake port directly and opens to said air inlet via said air filter.

7. The head structure of an internal combustion engine as claimed in claim 1, further comprising:

an integrated connector mounted externally of said cover member; and a plurality of terminals connected electrically to said electromagnetic valve driving apparatus and extending between said electromagnetic valve driving apparatus and said integrated connector along said cover member.

8. The head structure of an internal combustion engine as claimed in claim 7, wherein each of said terminals has a certain sectional area corresponding to a length thereof.

9. An internal combustion engine equipped with an electromagnetic valve driving apparatus comprising:

a cylinder head having an intake port openable to a combustion chamber;

an electromagnetic valve driving apparatus, said electromagnetic valve driving apparatus being installed in said cylinder head and driving a valve of the internal combustion engine;

a cover member covering said electromagnetic valve driving apparatus;

said cover member and said cylinder head providing an intake chamber; and said intake chamber being open to both an air inlet of the internal combustion engine and said intake port.

10. The internal combustion engine equipped with an electromagnetic valve driving apparatus as claimed in claim 9, further comprising:

said valve driven by the electromagnetic valve driving apparatus being an intake valve which opens and closes said intake port;

said cover member provided with said air inlet and an open portion which opens to said intake port;

an air filter being installed between said air inlet and said open portion so as to provide said intake chamber; and said intake chamber being open to said intake port directly and being open to said air inlet via said air filter.

11. The internal combustion engine equipped with an electromagnetic valve driving apparatus as claimed in claim 10, further comprising:

an injector for spraying fuel into the combustion chamber;

a combustion pressure sensor detecting a combustion pressure generated in the combustion chamber;

an air fuel ratio sensor detecting an air fuel ratio of a mixture inducted into the combustion chamber;

an accelerator sensor detecting an operation of an accelerator pedal;

an engine revolution speed sensor detecting an engine revolution speed;

an opening duration control means for controlling an opening duration of said intake valve by controlling said electromagnetic valve driving apparatus based on the combustion pressure, the air fuel ratio, the operation of the accelerator pedal and the engine revolution speed; and a fuel injection duration control means for controlling a fuel injection duration by controlling said injector based on the combustion pressure, the air fuel ratio, the operation of the accelerator pedal and the engine revolution speed.

* * * * *

UNITED STATES PATENT AND TRADEMARK OFFICE

CERTIFICATE OF CORRECTION

PATENT NO. : 5,720,242

DATED : February 24, 1998

INVENTOR(S) : Takashi IZUO

It is certified that error appears in the above-indentified patent and that said Letters Patent is hereby corrected as shown below:

ABSTRACT, line 6, delete "is".

Column 1, line 54, change "engin" to --engine--.

Column 3, line 56, change "82" to --32--.

Column 3, line 65, change "80" to --30--.

Column 3, line 67, change "80" to --30--.

Column 5, line 1, change "start" to --starts--.

Column 5, line 36, change "a" to --an--.

Column 5, line 37, change "a" to --an--.

Column 5, line 51, delete "is".

Column 6, line 3, change "opned" to --opened--.

Column 6, line 15, change "decrease" to --decreases--.

Column 6, line 17, change "increase" to --increases--.

Column 7, line 22, change "an" to --a--.

Column 7, line 51, change "an" to --a--.

Column 8, line 35, change "an" to --a--.

Column 8, line 57, delete "is".

UNITED STATES PATENT AND TRADEMARK OFFICE

CERTIFICATE OF CORRECTION

PATENT NO. : 5,720,242

DATED : February 24, 1998

INVENTOR(S) : Takashi IZUO

It is certified that error appears in the above-indentified patent and that said Letters Patent is hereby corrected as shown below:

Column 9, line 51, change "an com-" to --a com---.

Column 11, line 45, delete the period before "combustion".

Column 13, line 12, change "180" to --130--.

Column 13, line 13, change "188" to --138--.

Column 13, line 56, change "being" to --is--.

Column 13, line 59, change "wherein;" to --wherein:--.

Signed and Sealed this

Eighth Day of September, 1998

*Attest:*

Bruce Lehman

BRUCE LEHMAN

*Attesting Officer*

*Commissioner of Patents and Trademarks*